United States Patent [19]

Kaminski

[11] Patent Number: 4,606,456

[45] Date of Patent: Aug. 19, 1986

[54] MULTI-USE PACKAGE

[75] Inventor: Darryl L. Kaminski, Greendale, Wis.

[73] Assignee: EZ Paintr Corporation, Milwaukee, Wis.

[21] Appl. No.: 713,974

[22] Filed: Mar. 20, 1985

[51] Int. Cl.[4] ..... B65D 75/14; B65D 5/50

[52] U.S. Cl. ..... 206/362.4; 206/362.3; 206/492; 229/40; 229/87 R; 53/473; 493/137; 493/162; 493/397

[58] Field of Search ..... 206/362.4, 362.3, 248, 206/492, 273, 814; 229/22, 40, 87 R; 53/413, 455, 473; 493/136, 137, 162, 397, 399

[56] References Cited

U.S. PATENT DOCUMENTS

| | | | |
|---|---|---|---|
| 1,852,679 | 4/1932 | Schneider | 206/362.4 |
| 1,931,293 | 10/1933 | Morck | 206/362.4 |
| 2,216,543 | 10/1940 | Schumann | 206/362.4 |
| 2,506,954 | 5/1950 | First | 206/362.4 |
| 2,609,920 | 9/1952 | Ringler | 206/362.4 |
| 2,841,273 | 7/1958 | Scott | 206/362.4 |
| 3,380,643 | 4/1968 | Sorensen et al. | 229/40 |
| 3,391,782 | 7/1968 | Kaspar | 229/40 |

*Primary Examiner*—William Price
*Assistant Examiner*—Brenda J. Ehrhardt
*Attorney, Agent, or Firm*—McDermott, Will & Emery

[57] ABSTRACT

A novel structure for a paint brush package is disclosed. The structure consists of a single sheet of pliant material scored with multiple foldlines for assembly. When folded and erected, a wedge-shaped container having an inner liner forming a false bottom is produced. A plurality of scored fold sites permit the depth of the false bottom to be varied as desired. Changing the depth of the false bottom effectively changes the size of the container. This may be done by the manufacturer or by the consumer.

8 Claims, 6 Drawing Figures

MULTI-USE PACKAGE

BACKGROUND

1. Field of the Invention

The present invention relates generally to an improved wrapper or package for paint brushes. More particularly, the present invention relates to a wedge-shaped paint brush package that erects adjustably to properly accommodate different-sized brushes.

2. Brief Description of the Background Art

The use of paperboard structures as containers is well known. These structures are generally economical to produce, simple in form, and easy to assemble.

Paperboard packages have been designed for paint brushes for some time. They have often been of wedge shape and have been designed to protect a brush's bristles and ferrule during handling, shipment, display, storage before and after sale and after use. Further highly desirable uses for these containers include keeping the brush clean of dirt and dust, absorbing the paint solvents used to clean the bristles after use and keeping the bristles from collapsing from the brush's own weight when it is stored.

All of these uses function better when the package fits the brush well. If the package is too tight, the bristles will cramp and warp, and tend to stay warped permanently. If the package is too large the bristles tend to get dirtier, and because larger containers are inherently weaker than smaller containers, will afford less protection to the brush. For these reasons, paint brush manufacturers have found it necessary to provide different packages for differently-sized brushes, despite the additional costs thereby incurred. It would therefore be highly desirable to provide one paint brush package that could adjust to properly fit a number of paint brushes.

Various proposals for paint brush wrappers or packages have been disclosed such as those structures shown in U.S. Pat. Nos. 2,841,273, 2,609,920, 2,216,543, 1,931,293 and 1,852,679. While the packages shown in these devices can be made from paperboard or the like, they are generally designed for one particular paint brush and cannot be easily adapted to accoummodate various sizes of paint brushes.

SUMMARY OF THE INVENTION

The principal object of the present invention is to provide for a paint brush package adjustably erectable to fit paint brushes of various sizes.

In a broad embodiment, therefore, this object and others are provided by an improved paint brush package construction. This package construction is shaped from a single sheet of stock. The design, when erected, provides an inner flap forming a false bottom inside the package. This false bottom can be folded along scorelines in various permutations to effectively vary the depth of the package. In this manner, one package may properly fit a variety of brushes of a given width.

DETAILED DESCRIPTION OF THE DRAWINGS

Figure 1:
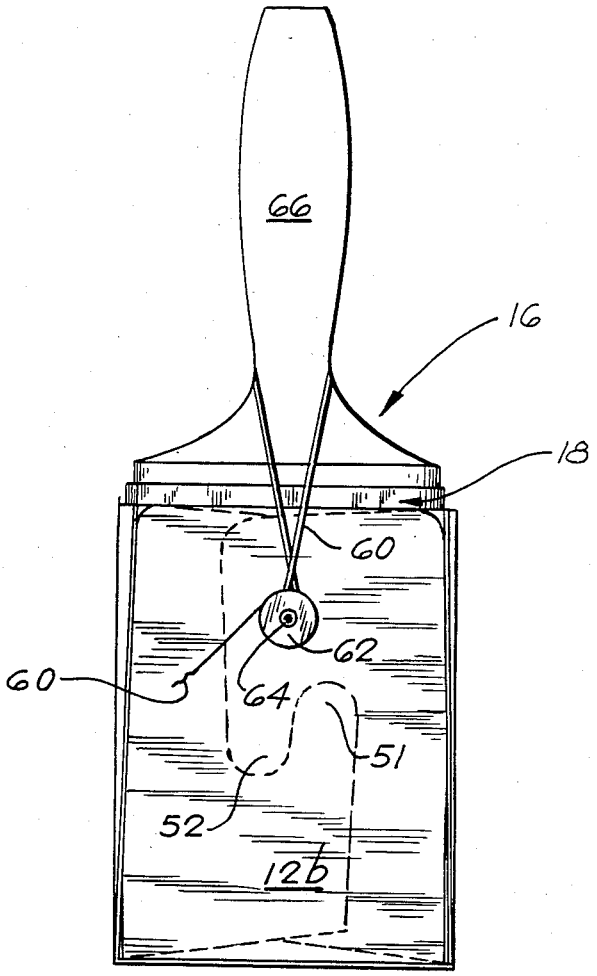
FIG. 1 is a front view of the present invention with a paint brush installed showing the closure flaps in phantom, for illustration.
Figure 2:
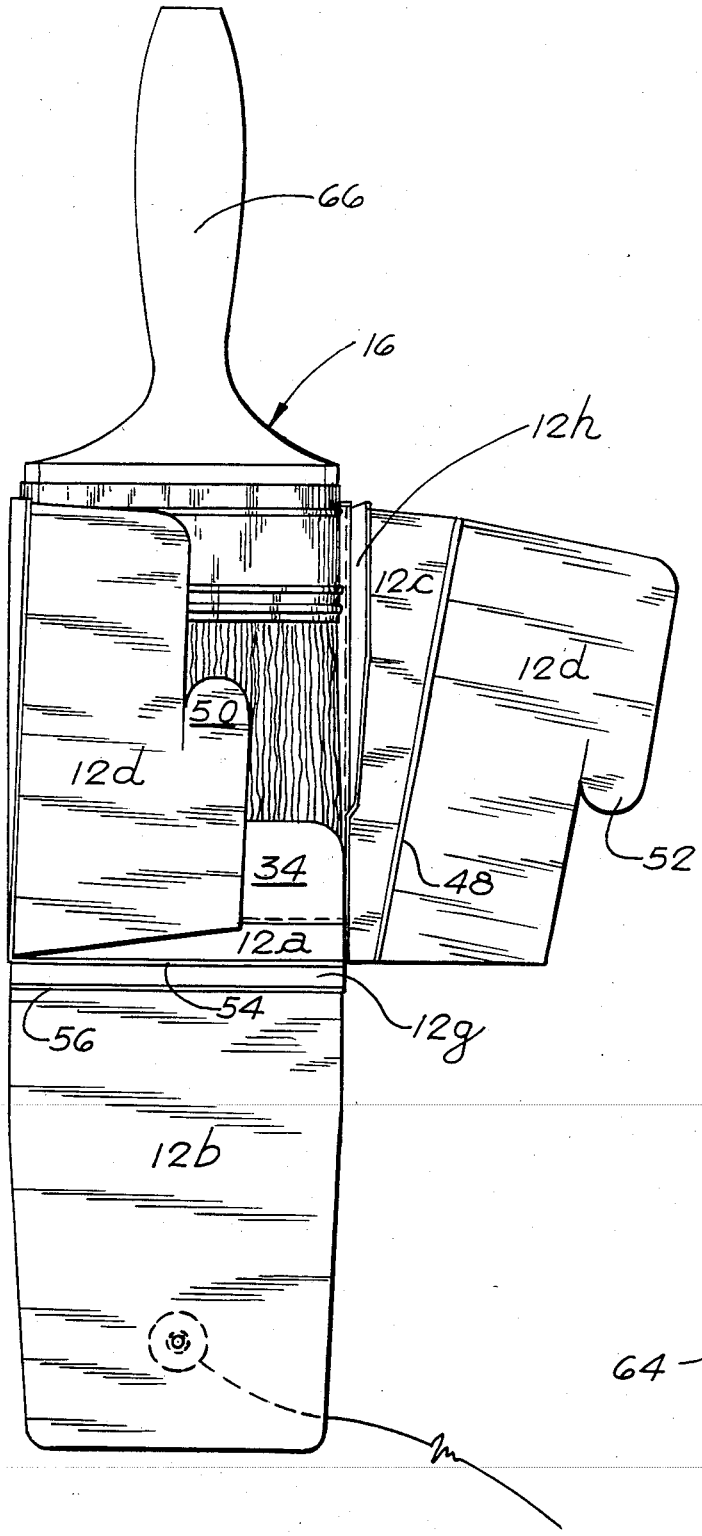
FIG. 2 is a front view of the present invention nearly assembled around an illustrative paint brush.
Figure 3:
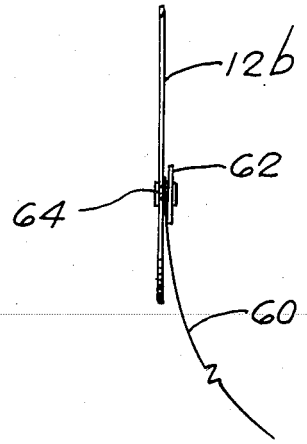
FIG. 3 is a partial side perspective view of the string and button securing feature of the present invention taken generally along the line 3—3 of FIG. 2.
Figure 4:
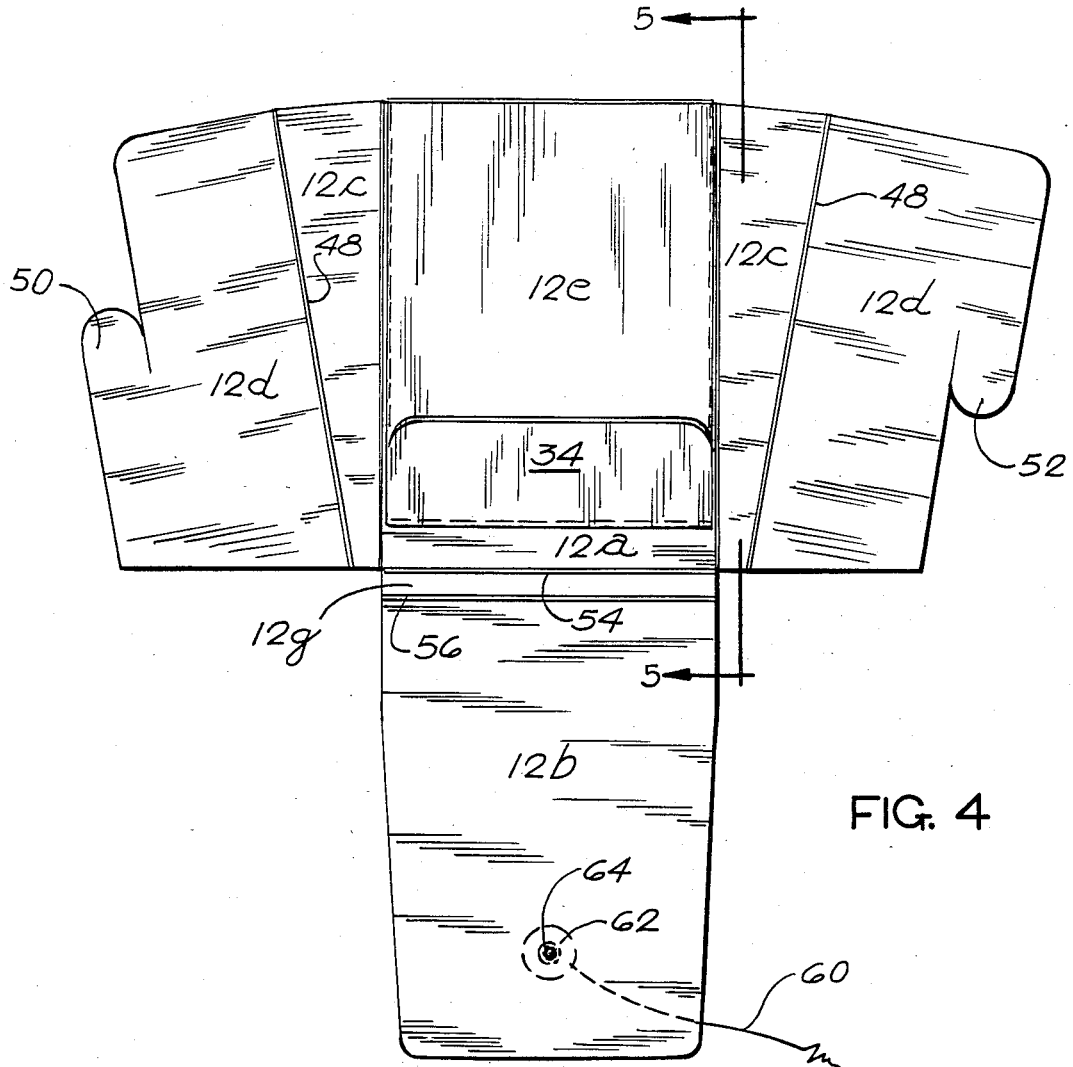
FIG. 4 is a front view of the present invention in the initial stage of assembly with the paint brush removed for clarification.

Referring to the drawings wherein like referenced characters are used for like parts throughout the several views, a truncated, generally wedge-shaped paint brush package, generally depicted 10 is shown. The package is cut from a flat blank 12 (FIG. 6) and scored with a plurality of folding marks or score lines, generally designated 14, to facilitate construction or assembly.

The package properly accommodates many paint brushes 16 of a given width but with varying depths and thicknesses. Therefore, instead of a paint brush manufacturer being required to provide an individual package for each model brush manufactured such as shown in the prior art, generally speaking, it need only provide a package for each width of paint brush produced.

To provide a package 10 for a paint brush 16, the width of ferrule 18 of the brush is determined. This width determines the package blank 12 size to be used to erect a container 10.

Figure 6:
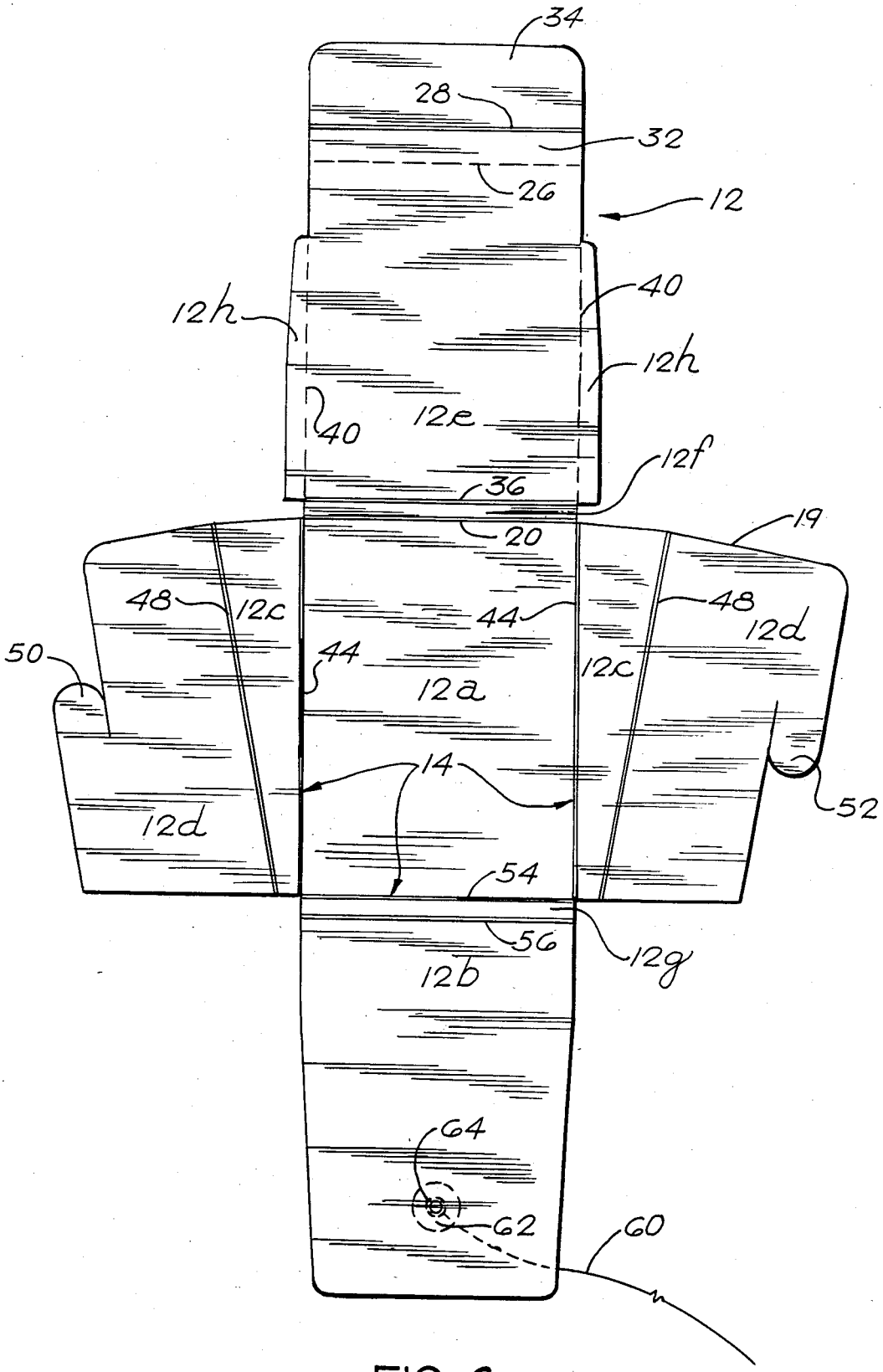
FIG. 6 is a front view of the completely disassembled present invention as cut from flat stock.

The blank 12, as shown in FIG. 6, is generally cross-shaped, being cut from a single sheet of paperboard along the outer perimeter line 19 by conventional methods. The blank includes several distinct elements which are identified as follows.

The center section connecting the extremity provides a back panel **12*a* which is connected at the bottom of FIG. 6 to a front panel 12*b*. On either side of the back panel 12*a* are a pair of generally triangular shaped side panels 12*c* which are similarly each connected to a closure panel 12*d*. An innerlying panel 12*e* is connected at the top of the back panel 12*a* by a top spacer panel 12*f*. The front panel 12*b* is similarly connected to the back panel 12*a* by a bottom spacer panel 12*g*. The spacer panels 12*f* and 12*g* and the purpose therefore will be described in greater detail in connection with the construction of the package. All of the panels 12*a*–12*g* are connected to the respective adjacent panel by a scoreline 14 formed by conventional means. In addition, a pair of optional side guidance flaps 12*h* are provided on either side of the innerlying panel 12*e*** by a perforated line to permit folding or removal thereof.

The package is constructed in accordance with the following, generally chronological steps.

First, the package blank 12 is manipulated at fold score 20. This folds the innerlying panel **12*e* of the invention over the back panel 12*a*. The innerlying panel 12*e* is then folded at its lower end to produce a depth appropriate to the particular brush 16. For instance, if a particularly short brush 16 is fitted, fold scores 26 and 28 would be used, resulting in an innerlying panel 12*e* with a bristle support section 32. For a larger tapered brush 16, fold score 28 could be used, resulting in a tapered bristle support seam on scoreline 28. For a shorter brush 16**, fold scores could be added as needed.

Figure 5:
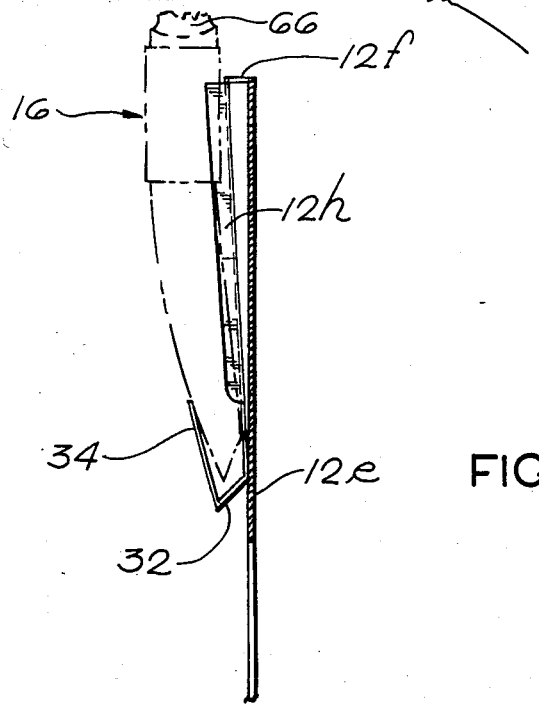
FIG. 5 is a side view of the present invention in the initial stage of assembly taken generally along the line 5—5 of FIG. 4 with the paint brush shown in phantom for illustration.

In the embodiment shown, scoreline 28 is a normal compressed line while scoreline 26 may be perforated to permit detachment of the bristle support section and the upwardly extending guide panel 34. In addition, the top spacer panel 12*f* formed between scoreline 20 and scoreline 36 can be left to remain flat against the back panel 12*a*, by not creasing the scoreline 36 for use with a brush having a relatively thick ferrule. For a similarly sized brush, having a reduced thickness ferrule, the spacer panel 12*f* is formed in a horizontal position as shown in FIG. 5 by forming a 90° crease at both scorelines 20 and 36.

At this stage, optional guidance flaps 12*h* are folded inwardly, toward the front along their scorelines 40. These guidance flaps 38 prevent bristles from working their way under the innerlying panel during storage thereby precluding permanent crimping and mutilation of said bristles. Additionally, they prevent pinching of the paint brush bristles both during removal from, and insertion in, an assembled package 10.

The optional guidance panels 12*h* are connected to the innerlying panel 12*c* by perforated scorelines 40 so that, if desired, the guidance panels 12*h* can be completely removed from the panel.

The next step in forming the paint brush holding cavity is to fold the side panels 12*c* at an angle of 90° with respect to the back panel 12*a* along the scorelines 44. Finally, the closure panels 12*d* are similarly folded at approximately 90° angles along their scorelines 48. This manipulation brings the interlocking closing tabs 50 and 52 into an overlapping relationship where they can be interlocked as shown in FIG. 1.

The final step in forming the package is to fold the front panel 12*b* over and in front of the closure panels 12*d*. As previously described, the front panel 12*b* is connected to the back panel 12*a* by a spacer panel 12*g*. A pair of scorelines 54 and 56 connect the bottom spacer panel 12*g* to its respective adjacent side. If a thin brush with tapered bristles is being packaged, the total amount of space required within the wrapper between the front wall 12*b* and the back wall 12*a* will not be as great as when a substantially thicker or fuller brush is being used. Therefore, the scorelines 45 and 54 will be creased and folded so that the front panel can pivot up into a generally parallel orientation with respect to the back panel 12*a* whereby the spacer panel 12*g* forms a generally flat bottom for the package. The ends of the spacer panel 12*g* will generally mate with the bottom ends of the side panels 12*c* as shown in FIG. 1. This results in the bottom panel 12*g* being of sufficient width to accommodate the bristle support section 32 formed at the bottom of the innerlying panel. If the paint brush is substantially shallower or thinner, scoreline 56 need not be used or creased which would eliminate the bottom spacer panel 12*g* which is not required to accommodate the bristle support section 32.

The paint brush 16 is releasably secured inside the assembled package 10 by a string 60 permanently secured under a button 62 by a fastener 64, such as a rivet or a grommet. The string 60 is wrapped around the protruding paint brush handle 66 and then brought back to be wrapped around the fastener 64 and thereby releasably securingly pinched under the button 62.

I claim:

1. A storage container for use with variable size paint brushes erectable from a one piece integral blank of scored, pliant material comprising:

a main panel adapted to form the rear side of the container generally parallel to one face of a brush;

a pair of opposed, generally tapered side panels foldably connected along a score line to the side edges of said main panel;

a pair of interlocking closure flaps foldably connected along a score line to the forward edges of said side panels;

a front wall panel foldably connected along a score line to the bottom edge of the main panel; and an innerlying, adjustable spacer panel foldably connected along a score line to the upper edge of the main panel, said spacer panel comprising at least two score lines, one of said score lines providing means to size the brush receiving opening and the second score line providing means for varying the depth of said innerlying adjustable spacer panel to accommodate brushes having different bristle lengths.

2. The foldably erectable container of claim 1 further comprising bristle guidance means for inserting and removing inserting brushes.

3. The foldably erectable container of claim 2 wherein said guidance means is a pair of optional guidance flaps foldably connected to the sides of the inner liner at a score line.

4. The foldably erectable container in claim 3 further comprising means for releasably securing said brush in the erected container.

5. The foldably erectable container of claim 4 wherein said securing means comprises a string and button fastener.

6. A method of making a paint brush package comprising the steps of:

providing an integral blank of pliant material defining a back panel, an innerlying panel, a pair of side panels, a pair of closure panels and a front panel;

defining said plurality of panels by providing a scoreline between the back panel at its edges adjacent the innerlying panel, the side panels and the front panel;

providing an additional scoreline on the innerlying panel to provide a spacer panel;

providing an additional scoreline on the innerlying panel to provide a flap folded to form a variable depth cavity for receiving a paint brush;

providing a scoreline between each of the side panels and the closure panels; and constructing the package by folding the innerlying panel and front panel through an angle of more than 90° and by folding the side panels and closure panels at their scorelines through an angle of approximately 90°.

7. The method of claim 6 including releasing securing means for securing a paint brush in the package.

8. The method of claim 7 wherein said releasable securing means includes a rivet and string for wrapping about the handle and securing to the package.

* * * * *